US007410376B2

(12) United States Patent
Ying et al.

(10) Patent No.: US 7,410,376 B2
(45) Date of Patent: Aug. 12, 2008

(54) MEMORY CARD ADAPTER WITH IMPROVED LOCKING MECHANISM FOR MATING WITH A MINI MEMORY CARD

(75) Inventors: Hao Ying, Kunshan (CN); Jin-Kui Hu, Kunshan (CN); Guo-Hua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/714,443

(22) Filed: Mar. 6, 2007

(65) Prior Publication Data

US 2007/0207676 A1 Sep. 6, 2007

(30) Foreign Application Priority Data

Mar. 6, 2006 (CN) ..... 2006 2 0070000 U

(51) Int. Cl.
*H01R 13/62* (2006.01)

(52) U.S. Cl. ..... 439/159; 439/76.1; 439/630

(58) Field of Classification Search ..... 439/159, 439/530, 630, 76.1
See application file for complete search history.

(56) References Cited

U.S. PATENT DOCUMENTS

| | | | | |
|---|---|---|---|---|
| 6,394,827 | B2 * | 5/2002 | Nogami | 439/159 |
| 6,817,875 | B2 * | 11/2004 | Chang et al. | 439/159 |
| 6,890,195 | B2 * | 5/2005 | Nagata | 439/159 |
| 6,932,623 | B2 * | 8/2005 | Lai | 439/76.1 |
| 7,052,295 | B1 | 5/2006 | Lin | |
| 7,112,074 | B2 | 9/2006 | Nakai | |
| 7,179,129 | B1 * | 2/2007 | Hwang | 439/630 |
| 7,320,622 | B2 * | 1/2008 | Ying et al. | 439/630 |
| 2007/0218768 | A1 * | 9/2007 | Lee | 439/630 |

* cited by examiner

*Primary Examiner*—Michael C Zarroli
(74) *Attorney, Agent, or Firm*—Wei Te Chung

(57) ABSTRACT

A memory card adapter (100) for receiving a memory card (6) includes an upper cover (2), a lower cover (1) engaging with the upper cover and defining a receiving space (10) therebetween, a contact module (3) and a conductive member (4). The contact module (3) includes a number of contacts (31), an insulative beam (32) over-molding the contacts and an insulative locking arm (33) integrally extending from the beam. The locking arm has a hook (331) extending into the receiving space (10) for mating with the memory card. The conductive member (4) has multiple conductive pads (42) electrically connecting with the contacts (31).

16 Claims, 6 Drawing Sheets

MEMORY CARD ADAPTER WITH IMPROVED LOCKING MECHANISM FOR MATING WITH A MINI MEMORY CARD

BACKGROUND OF THE INVENTION

1. Field of the Invention

This invention generally relates to a memory card adapter, and more particularly to a memory card adapter with a locking mechanism for mating with a corresponding mini memory card.

2. Description of the Prior Art

In accordance with advances in miniaturization of small portable apparatuses such as a mobile phone, a digital still camera and a PDA, also the size of a memory card used among the electronic apparatuses is being reduced.

Nowadays, there is no uniform standard or specification in memory card area. There are multiple kinds of memory cards such as a CF card, a MMC card, a SD card, a MS card and a Micro SD card etc. What puzzles the electronic device manufactures is how to solve the compatibility of the cards, for example, how to use only one SD card connector for capitally electrically connecting with a complementary SD card and an uncorresponding Micro SD card which is much smaller than the SD card. Under this circumstance, a card adapter for accommodating a Micro SD card therein and electrically connecting with the SD card connector is needed.

Such memory card adapter is disclosed in U.S. Pat. No. 7,052,295 B1. The unveiled card adapter comprises a bottom cover, a top cover attached to the bottom cover and a contact module positioned between the top and bottom covers. The contact module comprises plural contacts, plural pads, multiple transition portions connecting the contacts and the pads, and an insulator over-molding the transition portions. The contact module further includes a locking arm integrally stamped from a metal sheet and connecting with a lateral side pad. However, such metal locking arm can't assure excellent precision because the thin thickness of the metal sheet. Besides, the locking arm is probable so flexible that it may can't provide enough intensity for locking the inserted memory card.

Hence, it is desired to have a memory card adapter solving the problems above.

BRIEF SUMMARY OF THE INVENTION

Accordingly, an object of the present invention is to provide a memory card adapter with improved locking mechanism for mating with a corresponding mini memory card and preventing the mini memory card from being extracted abnormally.

In order to attain the objective above, a memory card adapter for receiving a memory card comprises an upper cover, a lower cover engaging with the upper cover and defining a card receiving space therebetween, a contact module and a conductive member. The contact module comprises a plurality of contacts, an insulative beam over-molding the contacts and an insulative locking arm integrally extending from the beam. The contacts comprise a plurality of contact portions extending into the card receiving space and a plurality of soldering portions. The conductive member has multiple conductive pads and a plurality of conductive wires electrically connecting with the conductive pads. The soldering portions of the contacts are soldered with the conductive wires so that the conductive pads can connect with the contact portions. Besides, The locking arm has a hook at a distal end thereof and extending into the receiving space for mating with the memory card. With this arrangement, the insulative locking arm integrally protruding from the beam can simplify the manufacture of the contact module through molding process. The insulative locking arm can provide excellent precision especially the dimension of the hook for freely mating with the memory card. Further more, the insulative locking arm can easily ensure enough intensity for locking the inserted memory card.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT OF THE INVENTION

Figure 1:
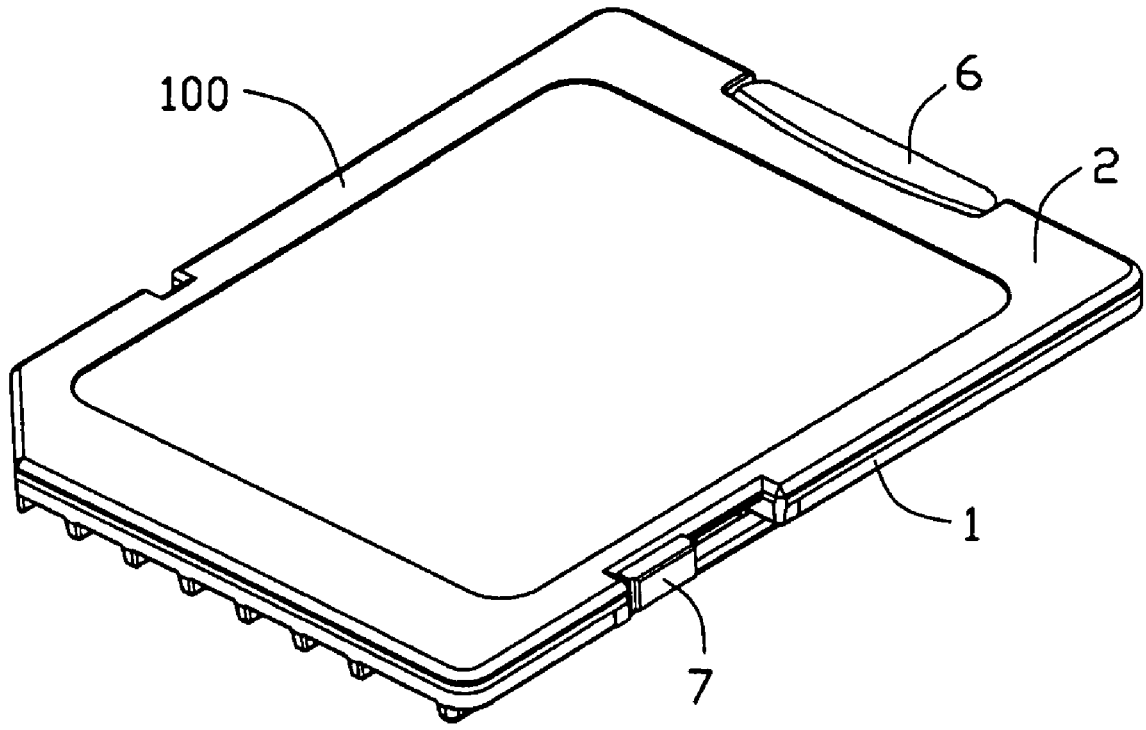
FIG. 1 is a perspective view of a memory card adapter according to a preferred embodiment of the present invention with insertion of a mini memory card.
Figure 2:
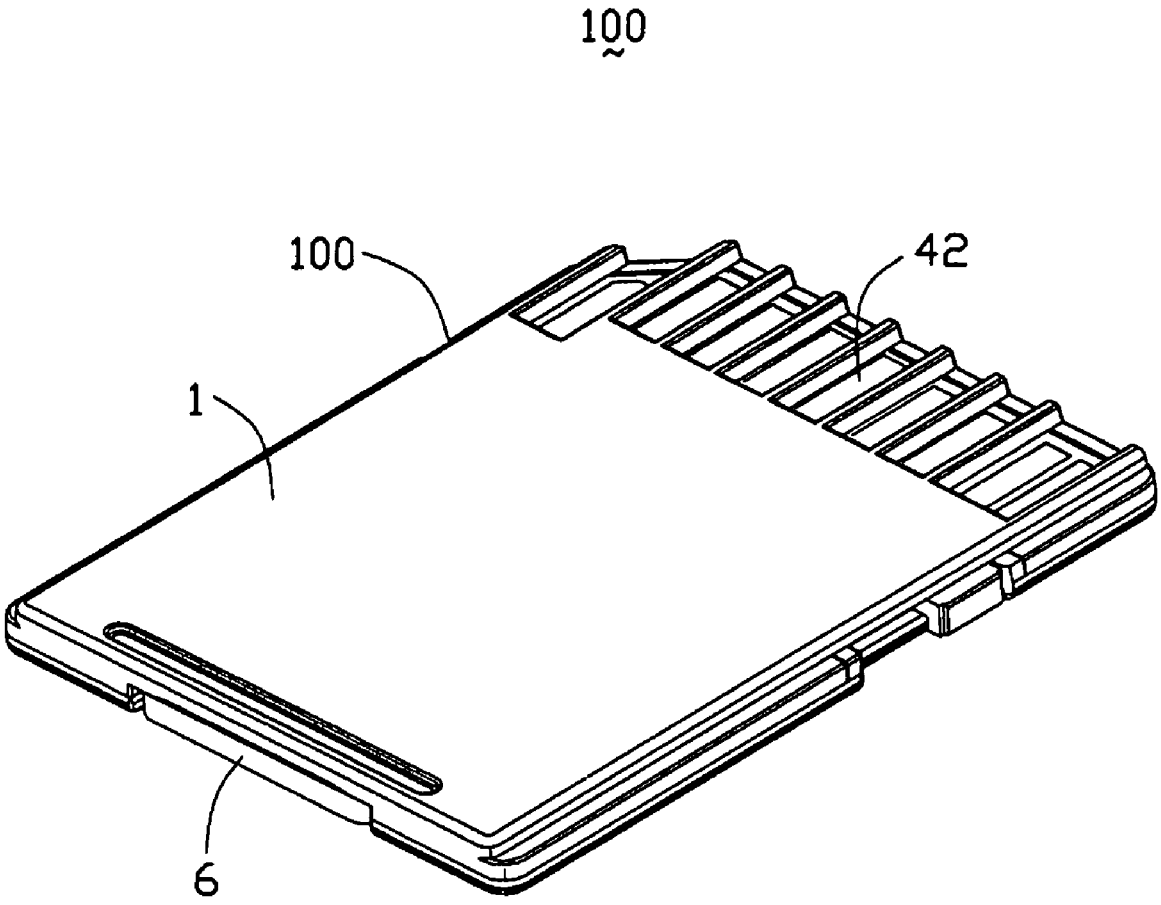
FIG. 2 is another perspective view similar to FIG. 1, while taken from another aspect.
Figure 3:
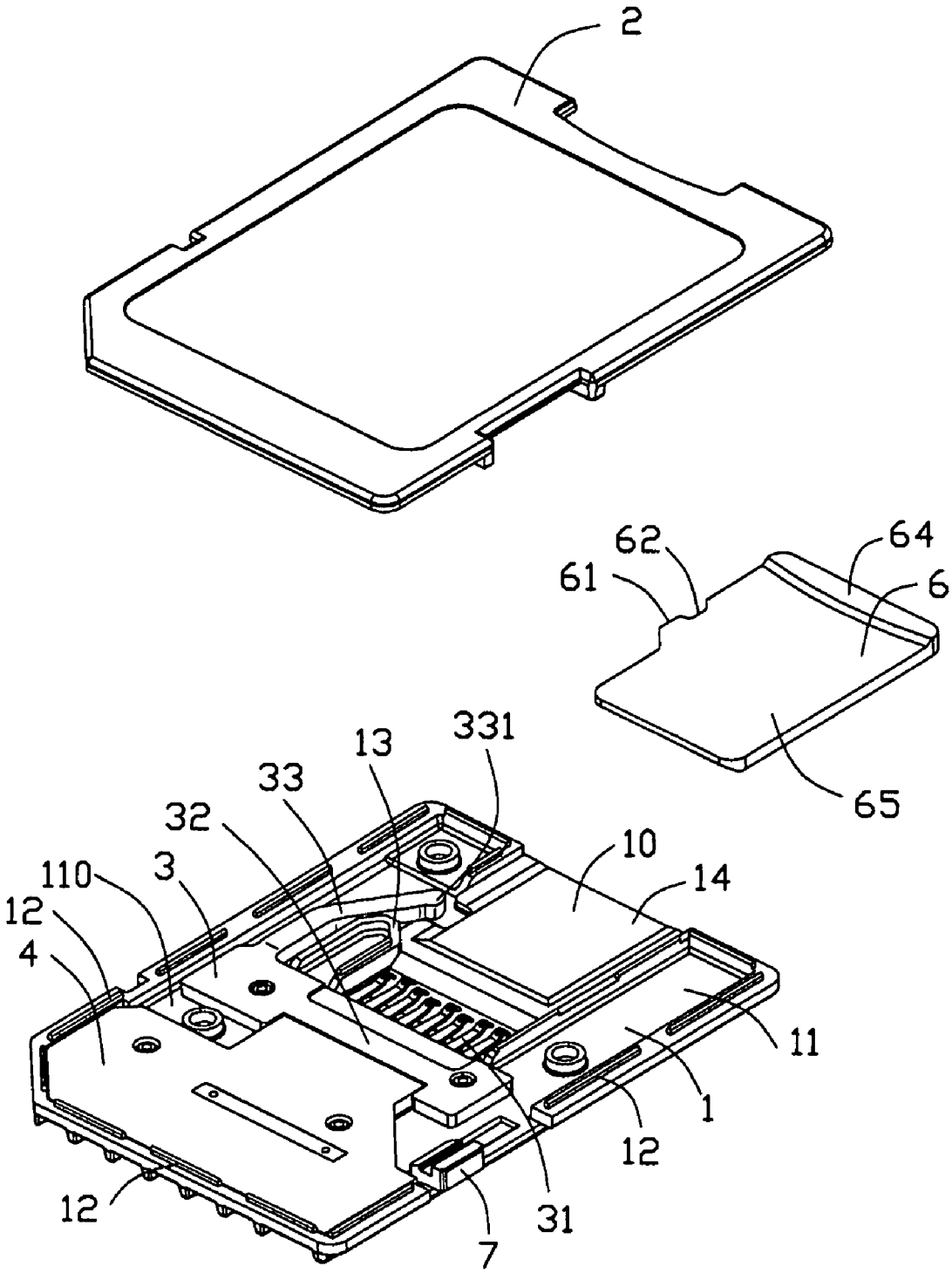
FIG. 3 is a perspective view of the memory card adapter showing the mini memory card detached from the memory card adapter and without an upper cover being mounted thereon.

Reference will now be made in detail to the preferred embodiment of the present invention.

Referring to FIGS. 1-4, a memory card adapter 100 for receiving a mini memory card 6 comprises a lower cover 1 extending along a front-to-back direction, an upper cover 2 attached to the lower cover 1, a contact module 3 and a conductive member 4 mounted on a top face 110 of the lower cover 1. The upper and lower covers 2, 1 are both made of insulative material such as resin. A mini memory card receiving space 10 with a configuration substantially as the mini memory card 6 is provided at a rear portion of the upper and lower covers 2, 1. The contact module 3 electrically connects with the conductive member 4 and comprises a plurality of contacts 31, a beam 32 over-molding the contacts 31 and an insulative locking arm 33 integrally extending rearwardly from the beam 32 and extending into the card receiving space 10 for mating with the inserted mini memory card 6.

Figure 5:
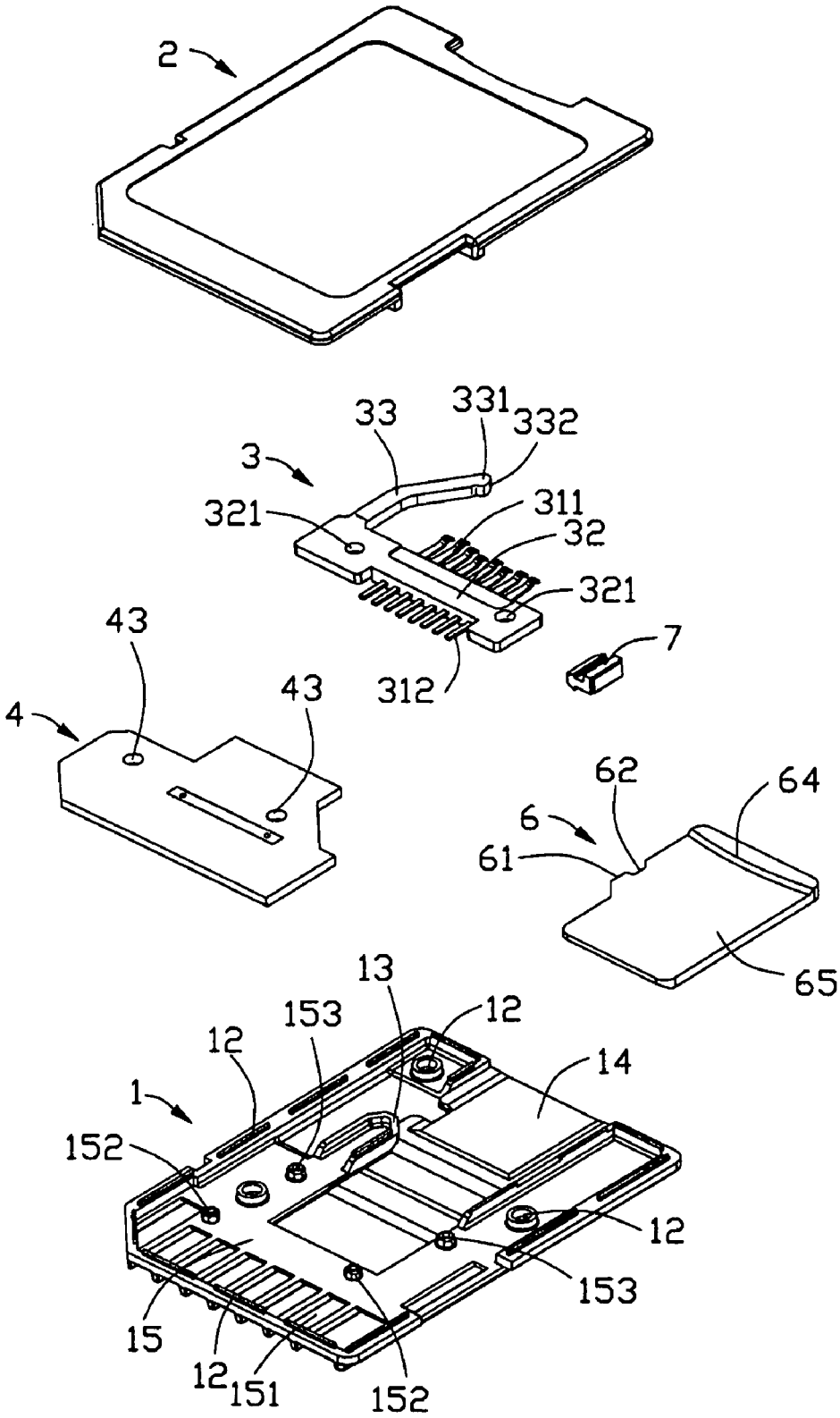
FIG. 5 is an exploded view of the memory card adapter shown in FIG. 1.
Figure 6:
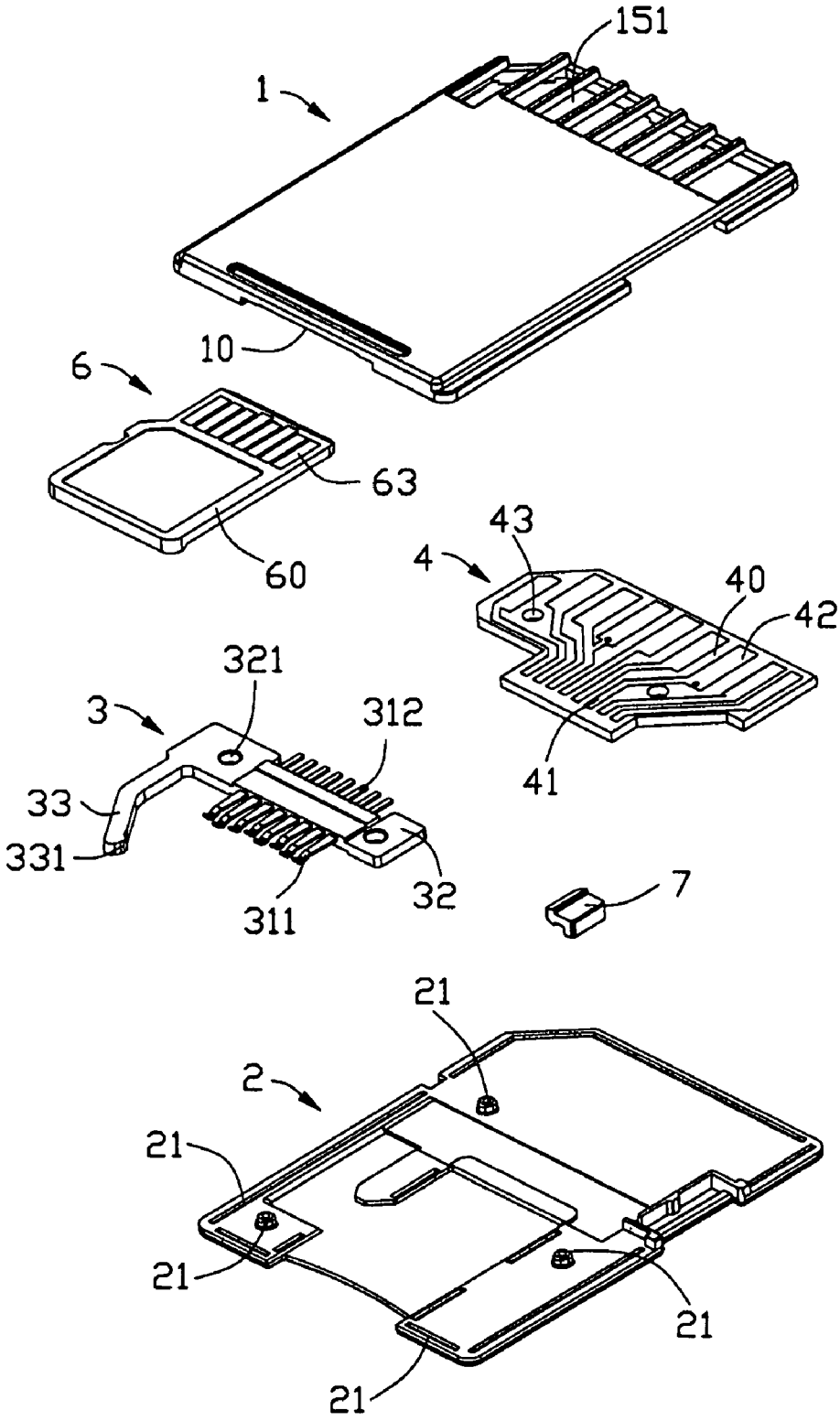
FIG. 6 is another exploded view of the memory card adapter shown in FIG. 2.

Further referring to FIGS. 5-6, the lower cover 1 comprises a bottom wall 11 with a mating depression 14 corresponding to the card receiving space 10 and a front portion 15 opposite to the mating depression 14. The top face 110 is disposed on the inner side of the bottom wall 11. The front portion 15 defines a plurality of rectangle shaped through openings 151 arraying in a direction perpendicular to the front-to-back direction. There sets a pair of first positioning posts 152 at the front of the through holes 151 and another pair of second positioning posts 153 located at the front of the first positioning posts 152. The first and second positioning posts 152, 153 extend upwardly from the top face 10 of the bottom wall 11 and are adapted for mating with the conductive member 4 and the contact module 3, respectively. Besides, the lower cover 1 comprises a stop portion 13 protruding into the mating depression 14 for preventing excessive insertion of the memory card 6. The lower cover 1 comprises a plurality of engaging members 12 protruding upwardly and the upper cover 2 has a plurality of corresponding mating members 21 mating with the engaging members 12 so that the upper and lower covers 2, 1 can be combined together.

Each contact 31 of the contact module 3 comprises a contact portion 311 extending backwardly into the card receiving space 10 and a soldering portion 312 extending forwardly for electrically connecting with the conductive module 4. Both of the contact portions 311 and the soldering portions 312 extend beyond the beam 32. The beam 32 defines a pair of holes 321 for receiving the second positioning posts 153 to fasten the contact module 3 on the lower cover 1. The insulative locking arm 33 integrally extends from a lateral side of the beam 32 and comprises a hook 331 at a distal end thereof. The hook 331 protrudes into the mating depression 14 and further includes a slant face 332 for guiding the insertion of the memory card 6.

The conductive member 4 in the preferred embodiment is a printed circuit board (PCB) which defines a plurality of conductive wires 41 on a bottom surface 40 thereof and a plurality of conductive pads 42 electrically connecting with the conductive wires 41 as shown in FIG. 6. The conductive wires 41 are soldered with the soldering portions 312 of the contacts 31 so that the contact portions 311 can electrically connecting with the conductive pads 42. The conductive member 4 comprises another pair of holes 43 for receiving the first positioning posts 152.

In assembly, the soldering portions 312 of the contacts 31 are soldered to corresponding conductive wires 41 to combine the contact module 3 together with the conductive member 4. The combination is positioned to the front portion 15 of the bottom wall 11 through the first and second positioning posts 152, 153 received in the holes 43, 321, respectively. The contact portions 311 of the contacts 31 as well as the locking arm 33 protrude into the card receiving space 10 for mating with the memory card 6. The conductive pads 42 of the conductive module 4 are positioned corresponding to the through openings 151 and expose outside of the lower cover 1. The upper cover 2 is attached to the lower cover 1 with the engaging members 12 abutting against the mating members 21 so that the upper and lower covers 2, 1 can be combined together. The memory card adapter 100 further comprises a button 7 slideably assembled in a side of the memory card adapter 100 for protecting read and write while using the memory card adapter 100. In the preferred embodiment, the whole configuration of the memory card adapter 100 is same as a standard SD card connector. The function of the button 7 is familiar to that of the standard SD card, so the detailed description about the button 7 is omitted herein. The memory card adapter 100 is adapter for receiving the memory card 6 which is a Micro SD card in the preferred embodiment.

Figure 4:
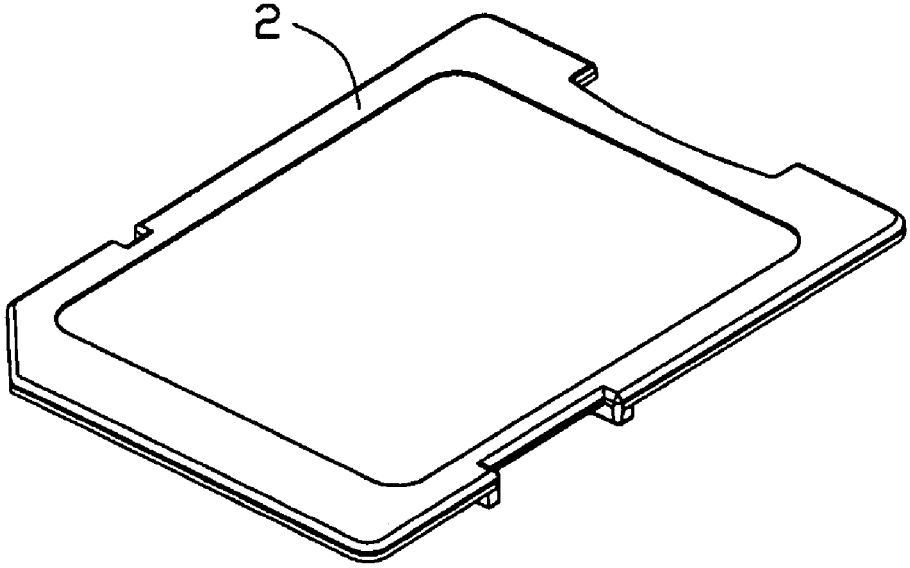
FIG. 4 is a perspective view of the memory card adapter showing the mini memory card inserted into the memory card adapter and without the upper cover being mounted thereon.
Figure 4:
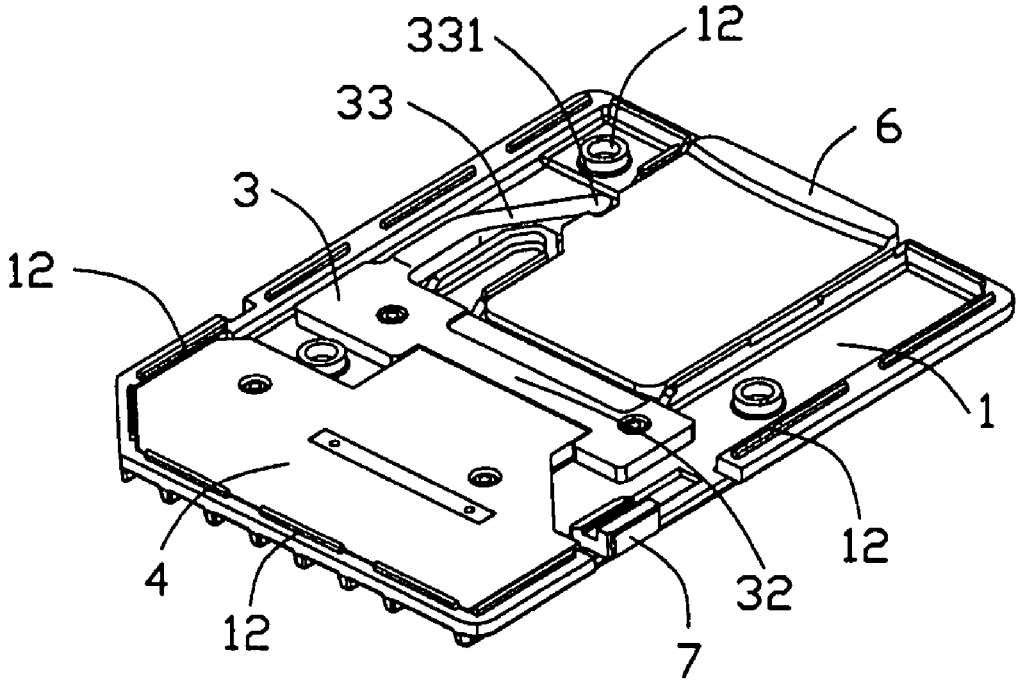

Referring to FIGS. 5-6, the memory card 6 includes a protrusion 61, a notch 62 adjacent to the protrusion 61 at a side thereof, a plurality of pads 63 formed on a bottom surface 60 thereof and a projecting portion 64 projecting upwardly from a top surface 65 thereof. In use, when the memory card 6 is inserted into the card receiving space 10 of the card adapter 100, the protrusion 61 is obstructed against by the stop portion 13 of the lower cover 1 and the projecting portion 64 may be obstructed against by a front end 23 of the upper cover 2 to prevent excessive insertion of the memory card 6. The pads 63 of the memory card 6 electrically connect with the contact portions 311 of the contacts 31. As a result, the mini memory card 6 is converted to the memory card adapter 100. Additional, as shown in FIG. 4, after the mini memory card 6 fully inserted into the card adapter 100, the locking arm 33 is driven by the memory card 6 to make the hook 331 projecting into the notch 62 of the memory card 6 for preventing the memory card 6 extracting from the card adapter 100 by accident.

Comparing with the prior art, the insulative locking arm 33 made through molding process integrally with the beam 32 can provide excellent precision especially the dimension of the hook 331 for freely mating with the memory card 6. Besides, the insulative locking arm 33 can easily ensure enough intensity for locking the inserted memory card 6.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A memory card adapter for receiving a mini memory card, comprising:

an upper cover;

a lower cover engaging with the upper cover with a card receiving space defined therebetween for receiving the mini memory card; and a contact module mounted on a top face of the lower cover and comprising a plurality of contacts, an insulative beam and an insulative locking arm integrally extending from the insulative beam, the contacts comprising a plurality of contact portions protruding into the card receiving space, the insulative locking arm having a hook extending into the card receiving space for mating with the mini memory card and;

a conductive member with a plurality of conductive pads electrically connecting with the contacts, the lower cover extending along a front-to-back direction and defining a plurality of through openings arrayed in a direction perpendicular to the front-to-back direction, the conductive pads exposed outside of the lower cover through corresponding through openings wherein, the conductive member comprises a plurality of conductive wires electrically connecting with the conductive pads, the contacts having a plurality of soldering portions extending beyond the insulative beam and being soldered with the conductive pads.

2. The memory card adapter according to claim 1, wherein the contacts are retained in the insulative beam.

3. The memory card adapter according to claim 1, wherein the contacts are over-molded in the insulative beam.

4. The memory card adapter according to claim 1, wherein the insulative locking arm is integrally molded with the insulative beam.

5. The memory card adapter according to claim 1, wherein the hook locks with a notch defined on a side of the mini memory card.

6. The memory card adapter according to claim 1, wherein the insulative locking arm extends from a lateral side of the insulative beam with the hook disposed at a distal end thereof.

7. The memory card adapter according to claim 1, wherein the hook comprises a slant face guiding insertion of the mini memory card.

8. The memory card adapter according to claim 1, wherein the lower cover comprises a stop portion protruding into the card receiving space for abutting against the mini memory card.

9. The memory card adapter according to claim 1, wherein the lower cover comprises a positioning post, the beam defining a hole receiving the post.

10. The memory card adapter according to claim 1, wherein the memory card adapter is a SD card adapter and the mini memory card is a Micro SD card.

11. An electrical card connector for receiving a memory card, comprising:

an upper cover;

a lower cover engaging with the upper cover forming a casing, with a card receiving space defined therebetween for receiving the memory card; and a contact module mounted between the upper and lower covers and comprising an insulative beam, a plurality of contacts retained in the beam and an insulative locking arm integrally extending from the beam, the contacts comprising a plurality of contact portions protruding into the card receiving space, the locking arm having a hook extending into the card receiving space for mating with the memory card and;

a printed circuit board having a plurality of traces thereon, said traces defining a first area in compliance with a first pitch of said contacts, and a second area having a second pitch larger than the first pitch and exposed to an exterior through said casing.

12. The electrical card connector according to claim 11, wherein the contacts are over-molded in the beam.

13. The electrical card connector according to claim 11, wherein the insulative locking arm is integrally molded with the insulative beam.

14. The electrical card connector according to claim 11, wherein the lower cover comprises a positioning post, the beam defining a hole receiving the post.

15. The adaptor as claimed in claim 11, wherein the casing defines a cutout around an insertion opening of the receiving space for receive a raised portion an inserted electronic card.

16. The adaptor as claimed in claim 11, wherein the contact module and the printed circuit board are respectively and independently fastened to the casing.

* * * * *